US005244280A

United States Patent [19]

Porter et al.

[11] Patent Number: 5,244,280

[45] Date of Patent: Sep. 14, 1993

[54] FLEXIBLE INTERMEDIATE BULK CONTAINERS

[75] Inventors: Clavin M. Porter; Jack D. Pierce; Sidney Cawyer; Colin L. Talbot, all of Magnolia, Ark.

[73] Assignee: Megasack Corporation, Magnolia, Ark.

[21] Appl. No.: 889,200

[22] Filed: May 27, 1992

[51] Int. Cl.[5] ..... B65D 33/10

[52] U.S. Cl. ..... 383/17; 383/24; 383/28; 383/107; 493/223; 493/226; 112/262.1; 112/400

[58] Field of Search ..... 383/24, 59, 107, 17, 383/67, 28; 493/223, 226; 112/400, 262.1

[56] References Cited

U.S. PATENT DOCUMENTS

| | | | |
|---|---|---|---|
| 2,103,092 | 12/1937 | Robinson | 383/59 X |
| 2,255,845 | 9/1941 | Goldwyn | 383/107 X |
| 4,207,937 | 6/1980 | Sandeman et al. | 383/24 X |
| 4,356,853 | 11/1982 | Sekiguchi | 383/24 |
| 4,521,911 | 6/1985 | Vance | 383/107 X |
| 4,524,457 | 6/1985 | Marino | 383/24 X |
| 4,597,102 | 6/1986 | Nattrass | 383/107 X |
| 4,603,432 | 7/1986 | Marino | 383/24 X |
| 4,646,357 | 2/1987 | Nattress | 383/107 X |
| 4,781,473 | 11/1988 | LaFleur | 383/24 X |
| 4,817,824 | 4/1989 | LaFleur et al. | 383/67 X |
| 4,963,037 | 10/1990 | Manerba | 383/24 |
| 5,158,367 | 10/1992 | Derby | 383/107 X |

FOREIGN PATENT DOCUMENTS

| | | | |
|---|---|---|---|
| 338181 | 10/1989 | European Pat. Off. | 383/24 |

*Primary Examiner*—Allan N. Shoap
*Assistant Examiner*—Christopher McDonald
*Attorney, Agent, or Firm*—Karl W. Flocks

[57] ABSTRACT

A flexible woven fabric bulk container made of four panels with vertical selvage sides, vertical warps and cut edges in the direction of the weft at the top and bottom, with diagonally extending interlocking hemmed corners with upper portions splayed or flared in a counter-clockwise direction and overlaid with inner and outer depending legs of inverted "U"-shaped loops.

5 Claims, 4 Drawing Sheets

FLEXIBLE INTERMEDIATE BULK CONTAINERS

This invention relates to woven fabric bulk containers of a type suitable for Intrastate and Interstate shipment and also for in-plant storage and use. More particularly, the bulk containers of the instant invention are for dry flowable products.

Containers of the character described are relatively large bags having a goemetrical configuration in the form of a rectangular paralelepiped. These containers which are used for storage and transport of particulate materials are required to hold extremely heavy loads of a ton or more. In the past, such containers have been made of woven fabric such as polypropylene and formed with vertical and horizontal seams. Manufacturers of such bags have been aware of the need to guard against sifting of particulate material through the seams. Handling of loaded containers has conventionally utilized the tines of a fork lift, and loops secured to the container have been provided for this purpose.

BACKGROUND

In the Specification of the U.S. Pat. No. 4,521,911, to Vance, filed in 1984, the Patentee stated:

> "Various proposals have been made for reinforcing bulk containers in the regions of high stress concentrations and for preventing or minimizing seam leakage, but many of such proposals involve the use of additional fabric or reinforcing material, reduction in bag capacity or increase in time and cost of container production."

Not only have such proposals been made in the past, but there have been attempts by many to meet the commercial requirements of users of such containers. As the intended contents of the containers have significant value, the spoilage or loss of which being intolerable, a requirement has been made by users including in-plant and field tests by users, safety tests performed by intrastate and interstate authorities and tests designed and carried out by independent labs who offer recognized certification. Failure to pass a test required for certification of a container designated for a specific load may be re-submitted for certification of the same container for a less load and a lesser load certification may be obtained in such case.

The U.S. Pat. No. to Williamson, 4,224,970, U.S. Pat. Nos. 4,457,456 and 4,479,243, to Derby and Williamson, assigned to Super Sack Manufacturing of Dallas, Tex., based on Application filed as early as 1977 and 1979, each discloses loop-supported flexible bulk material containers.

Illustrative of the fact that there were many workers in the field for a period of almost one hundred years is the Patent to Lobdell, U.S. Pat. No. 546,168, which goes back to Sep. of 1895.

Early workers in the field, Rolaf Lehmann and Sven Burnmeister of Germany, U.S. Pat. No. 4,658,432, having a priority date of 1985, emphasized the need for strength particularly the need for passing a drop test wherein the height of the drop is measured as being 120 cm and the flexible woven polypropylene container carries a load of 1,250 kg which load is not to be damaged after the loaded container is dropped.

The Patent to Beaven and Barcoe, U.S. Pat. No. 4,301,848, having a priority of 1978, discloses a flexible container for bulk particulate materials having four supporting loops. The fabric of the side walls is oriented with the weft vertical and the warp horizontal when the bag is in the normal upright position.

The Patent to Sandeman and Bell of Scotland, U.S. Pat. No. 4,207,937, having a priority date of 1977, discloses a flexible bulk container for particulate materials made of woven polypropylene, utilizing special warp threads adjacent to selvages near seams for improvement in strength.

Prolific workers in the field were Yorkshiremen Frank and Peter Nattrass. See U.S. Pat. No. 3,961,655 having a priority date of 1973; U.S. Pat. No. 4,010,784 having a priority of 1973; U.S. Pat. No. 4,010,784 having a priority of 1973; U.S. Pat. No. 3,961,655, having a priority of 1973; U.S. Pat. No. 4,307,764, having a filing date of 1980; U.S. Pat. No. 4,364,424, having a filing date of 1981; U.S. Pat. No. 4,493,109, having a priority date of 1982; U.S. Pat. No. 4,597,102, having a priority date of 1984; U.S. Pat. No. 4,610,028, having a priority date of 1984; U.S. Pat. No. 4,646,375, having a filing date of 1985.

All The Nattrass Patents have to do with loop-supported flexible bulk material containers of woven polypropylene. Some of the structures are made of tubular fabric and some are mode with planar sides having vertical seams to which a supporting loop may be secured. It is to be expected that, in view of the early Nattrass priority dates, the British constructions, including the four loop-supported bags of these Yorkshiremen, have been publicly known for more than seventeen years.

The Patent to Walter Polett and Muriel Polett, U.S. Pat. No. 4,499,599, filed in 1983, has to do with a polypropylene flexible bulk container with supporting loops extending from one side of the container to the other side.

The Patent to Kraus, U.S. Pat. No. 4,081,011, having a Priority Date of 1976, discloses a flexible container with suspension elements extending from one side of the container to the opposite side.

The Patent to Sekiguchi, U.S. Pat. No. 5,356,583, having a Priority Date of 1979, van de Pol, U.S. Pat. No. 4,664,957, having a Priority Date of 1985, and Marino, U.S. Pat. No. 4,524,457, filed 1984; Platt, U.S. Pat. No. 4,480,766, filed 1982; and Marino, U.S. Pat. No. 4,703,517, filed in 1986, show miscellaneous further work in the field of loop-supported flexible bulk containers.

During the testing of the bags produced by the joint inventors of the instant Application, there was occasion to observe the testing of bags produced by competitors which bags initially failed and could only pass by reducing the load for which the bags were certified or by increasing the weight of the fabric with the attendant increase in expense.

The bags made by the joint inventors passed the necessary load, drop, and other pertinent tests in a manner superior to what was observed of the testing of bags produced by competitors.

Although bags of the character of the flexible intermediate bulk container category were produced and utilized for many years in foreign countries and in particular in England and the European continent, the FIBC industry in the United States is relatively new and industry standards in the U.S. have not been greatly advanced.

SUMMARY AND OBJECTS OF THE INVENTION

It is an object of the instant invention to produce a stronger, efficient, economical, flexible intermediate bulk container meeting the requirements of the user.

It is another object of the instant invention to produce a flexible, intermediate bulk container which can be more readily manufactured and, at the same time, meet increased requirements for load carrying capability and drop test strength.

It is still a further object of the instant invention to provide and teach the construction of a flexible intermediate bulk container which will become a standard of the industry in the United States.

Another object of the instant invention is to achieve certification of a flexible bulk container capable of carrying a load of over two thousand pounds with a completely acceptable factor of safety and produced at the relatively low cost of polypropolene woven yard goods utilizing manufacturing steps capable of execution with high efficiency and without need for special custom materials.

Other objects and the nature and advantages of the invention will become apparent from the following description and drawings.

Figure 1:
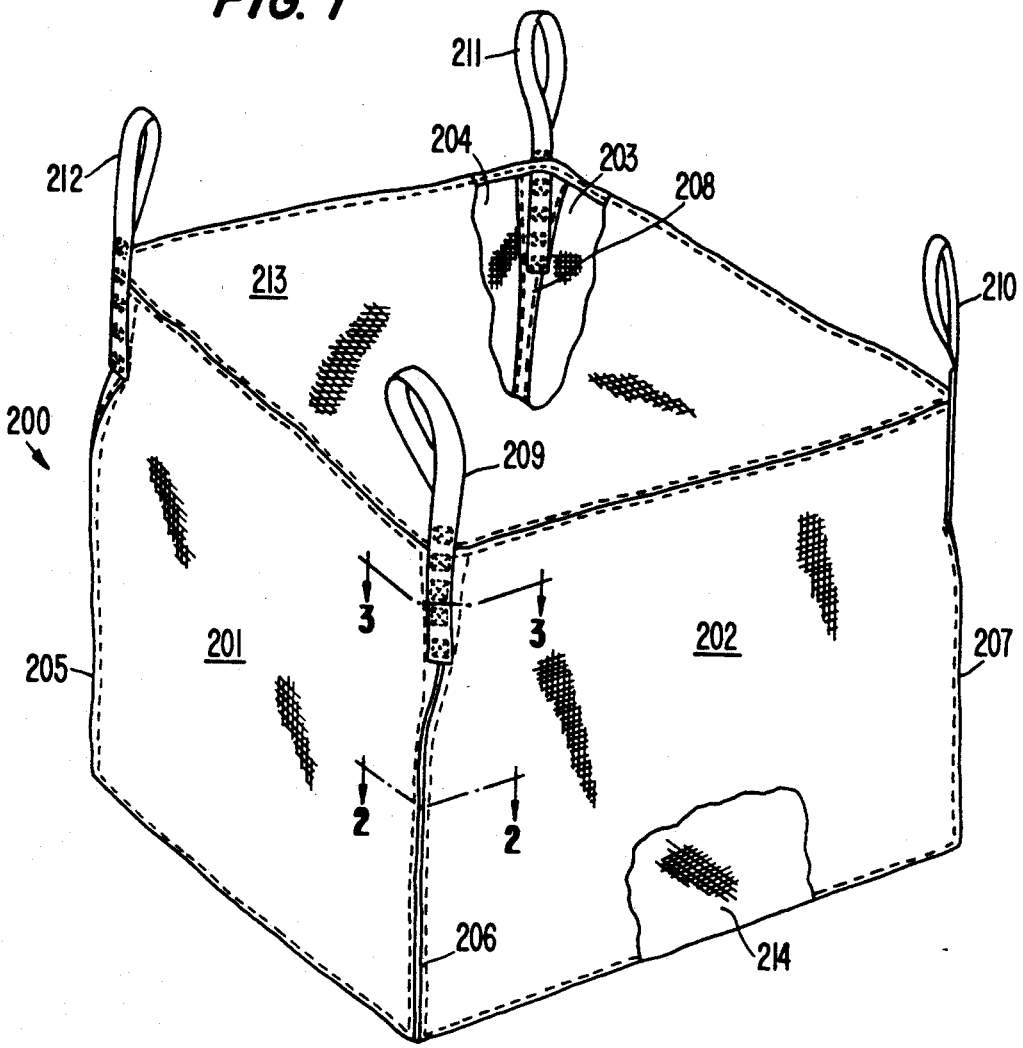
FIG. 1 is a view in perspective of the bag of the invention.

Referring to the drawings and more particularly to FIG. 1, 2, 3, FIG. 7, and FIG. 8, the flexible intermediate bulk container 200 comprises the vertical body panels 201, 202, 203, and 204. Connected to the vertical panels are the bottom horizontal panel 214 and the top horizontal panel 213. The panels 201, 202, 203, and 204 are connected to each other at vertical formations 205, 206, 207, and 208.

Figure 2:
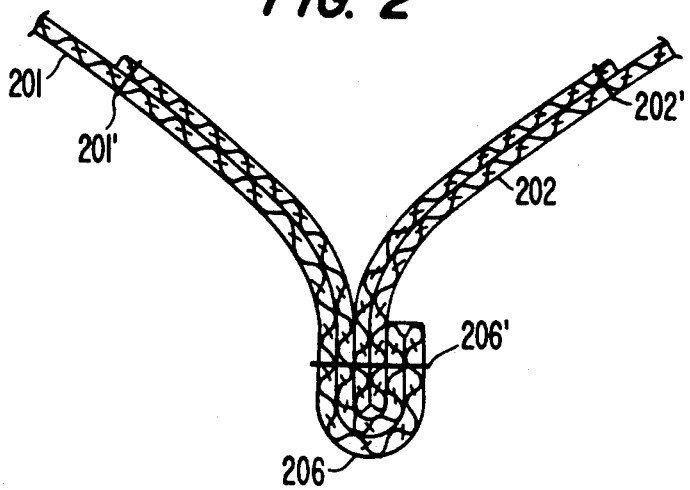
FIG. 2 is a horizontal section through line 2—2 of FIG. 1 and looking in the direction of the arrows.

As more particularly illustrated in the horizontal section shown in FIG. 2, the panel 201 includes a vertical hem stitched at 201'. The panel 202 includes a vertical hem stitched at 202'. The two layers of the hem 201' are folded back on themselves to form a "U" in section with the two legs of the "U" providing a space to receive the folded edge of the hem of the panel 202 so that four fabric thicknesses of the hem of the panel 201 in association with the two fabric thicknesses of the hem of the panel 202 make a total of six fabric thicknesses sewn together by the stitching 206'.

Figure 8:
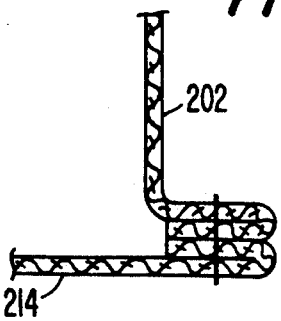
FIG. 8 is a fragmentary view in vertical cross section of the seam at the bag bottom periphery.

FIG. 8 is a fragmentary vertical cross section taken through the bottom of the container 200 illustrating how vertical panel 202 is stitched to the horizontal bottom 214.

Figure 7:
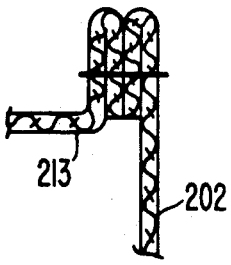
FIG. 7 is a fragmentary view in vertical cross section of the seam at the bag top periphery.

FIG. 7 is a fragmentary vertical cross section through the upper portion of the bag 200 illustrating how the vertical panel 202 is joined to the horizontal top 213.

The flexible intermediate bulk container 200, when loaded, is adapted to be supported by two conventional tines of a conventional fork lift, not illustrated, which tines are adapted to be passed through loops attached to the upper portions of the bag 200 and for this purpose the bag has four loops 209, 210, 211, and 212.

Each of the panels 201, 202, 203, and 204 is fabricated from vertical lengths of woven flat filaments or ribbons of the polypropylene. The hemming of these vertical panels is so arranged that the selvage is on the inside of the bag structure and the warp filaments or ribbons are vertical while the weft filaments or ribbons are horizontal. Thus, it will be understood that the stitching 206' illustrated in section in FIG. 2 is generally parallel to the fabric warp and the six thicknesses of fabric at the joint 206 taken together with the stitching 206' form a vertical member of the bag construction of relatively great tensile strength.

Figure 3:
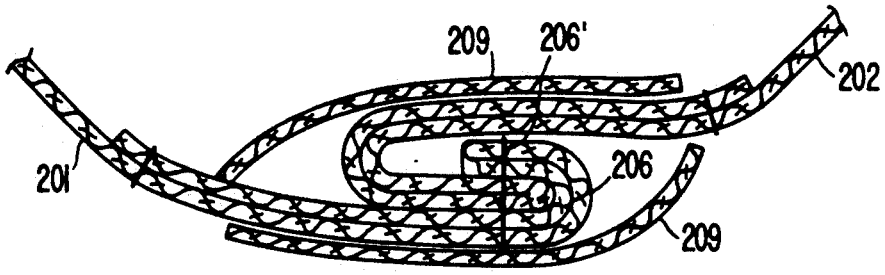
FIG. 3 is a horizontal section through line 3—3 of FIG. 1 and looking in the direction of the arrows.
Figure 4:
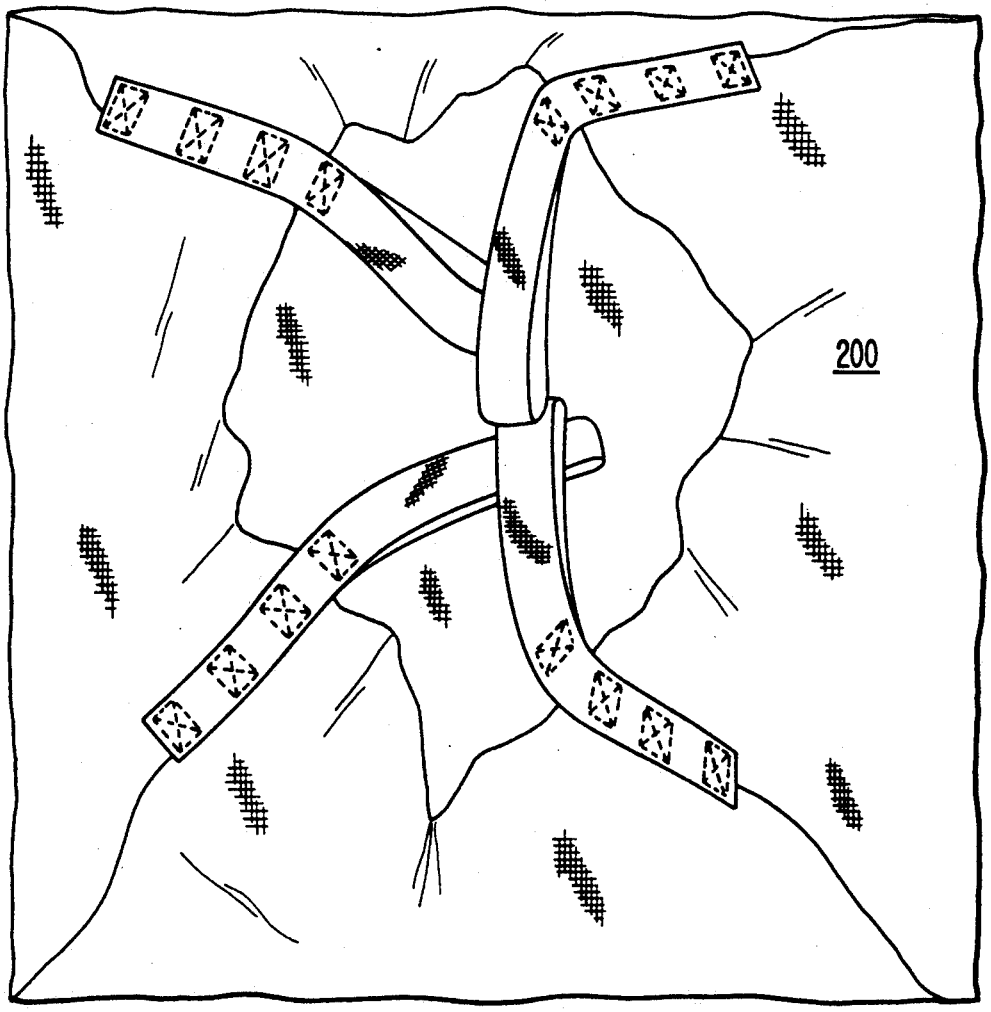
FIG. 4 is a view from above looking down on collapsed bag illustrating counter-clockwise rotation of attached loops and their assembly with bag body.

In line with each of the joints 205, 206, 207, 208, are the loops 212, 209, 210, 211, respectively. The loops 209, 210, 211, and 212, though not co-extensive, together with the joints 206, 207, 208, and 205 form completed vertical members of relatively great strength. The loop 209 is made of a high strength web material and is in the shape of an inverted "U" with two depending legs. The outside depending leg illustrated in section in FIG. 3 is adjacent the splayed or flared outside of the joint 206. The inside depending leg of the loop 209 is adjacent the inside portion of the hem of the panel 202 whereas the outside depending leg of the loop 209 is adjacent the panel 201 and the outside of the panel 202. It is to be noted that the stitching 206' is only through six fabric layers and does not at any time go through eight fabric layers. The specific attachment of the two depending legs of each of the loops, like the loop 209, is more particularly illustrated in FIGS. 4, 5, and 6. FIG. 4 which is a view from above looking down on the collapsed bag 200 illustrates all four of the loops.

Figure 5:
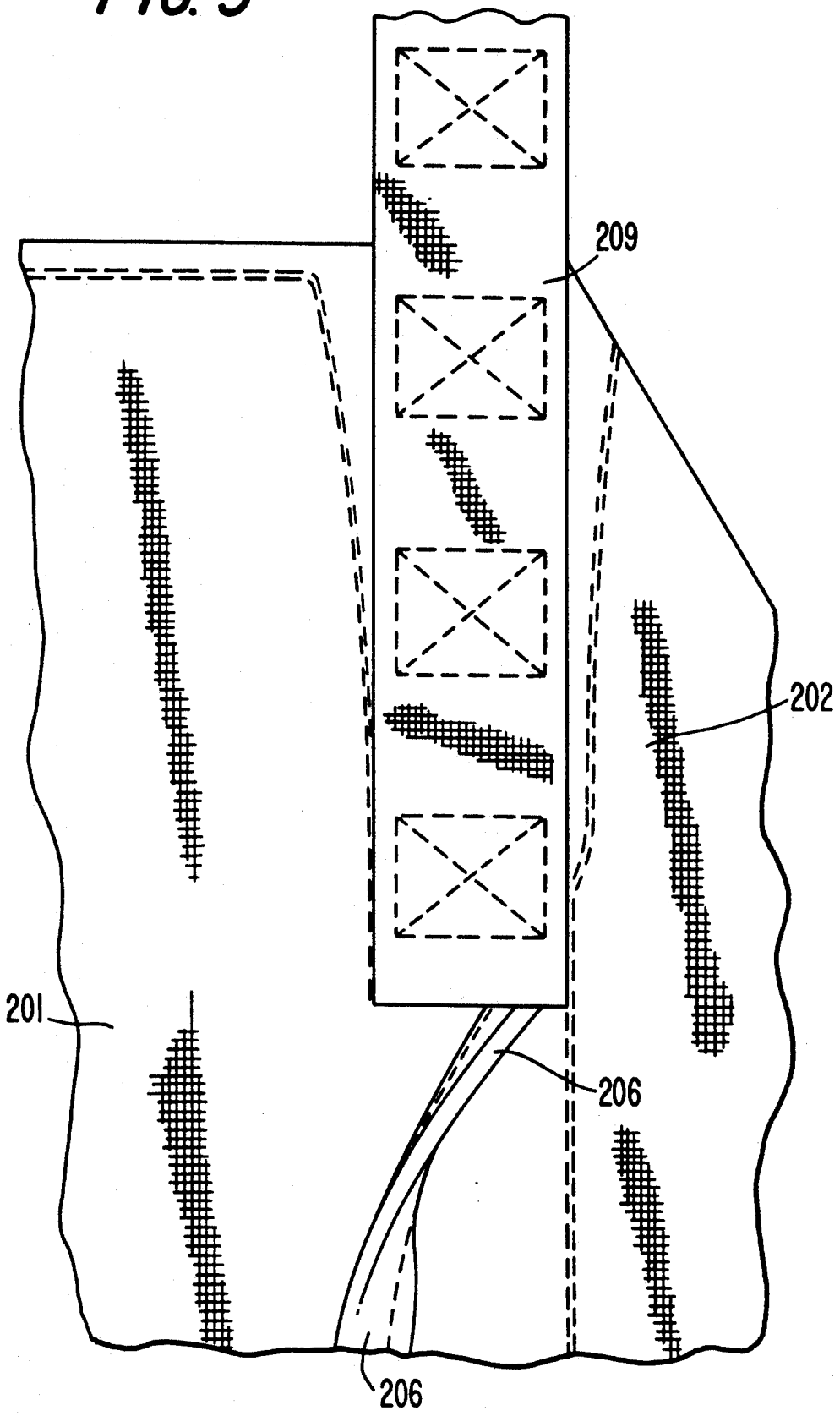
FIG. 5 is a view in elevation of a fragment of an outside corner of the bag illustrating the attachment of a loop to the bag body.
Figure 6:
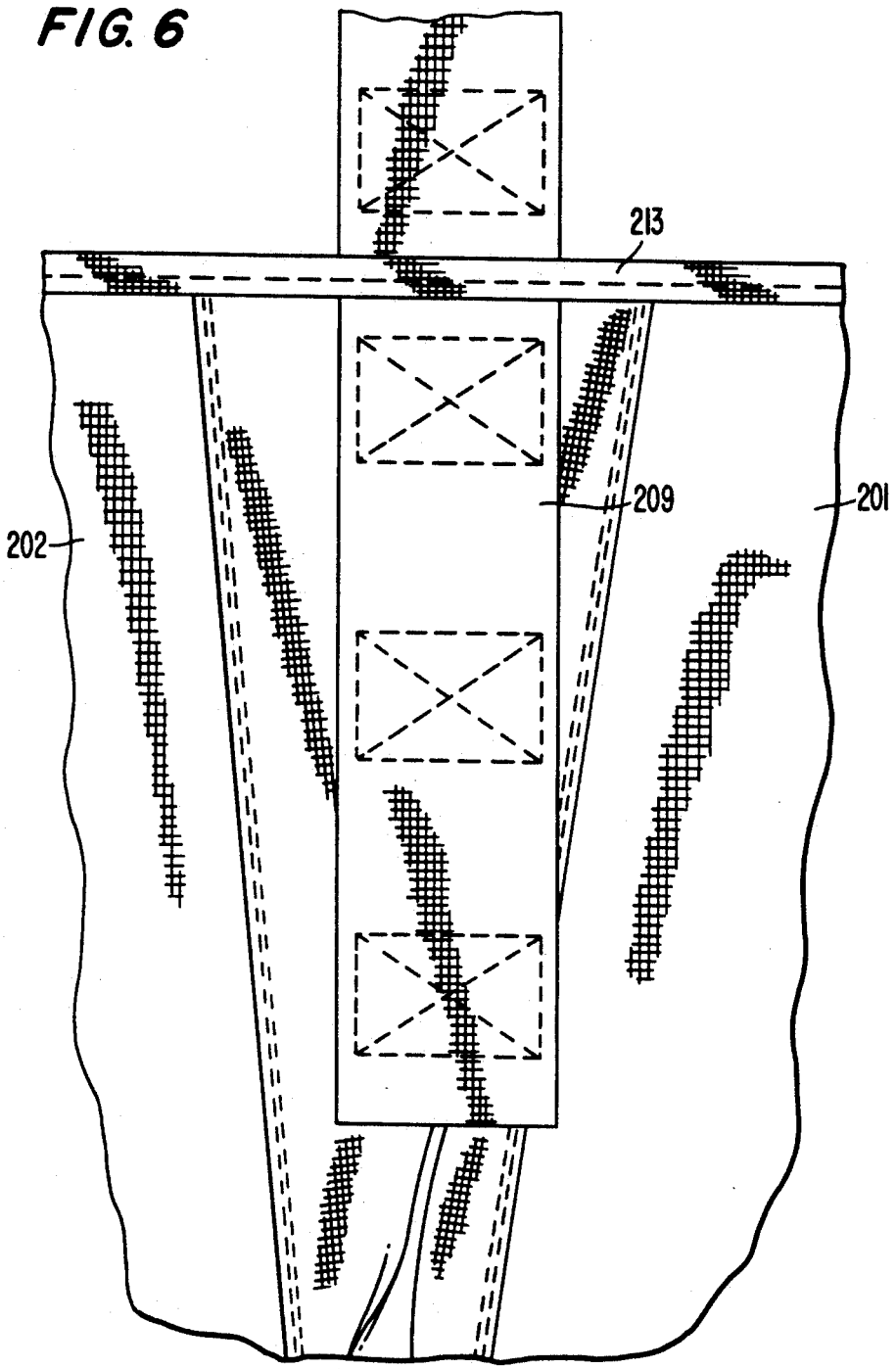
FIG. 6 is a view in elevation of a fragment of an inside corner of the bag illustrating the attachment of a loop to the bag body.

FIG. 5 and 6 are fragmentary views of the outside leg of the loop 209, respectively. FIG. 5 illustrates the attachment of the outside leg of the loop 209 to the bag 200 over the rotated joint 206 by a bar tack machine producing a series of vertically spaced "squares" and "X's". The outside leg of the loop 209 immediately above the peripheral margin of the bag is attached to the inside leg by an additional "square" and "X" stitch so that the two legs of the loop are joined to each other above the top of the bag.

The fragmentary view in FIG. 6 illustrates the inside leg of the loop attached over the joint 206 which is hidden from view by the depending inside leg which does not cover the selvages of the panels. Adjacent the selvages of the panels 201 and 202 are the pigmented warp filaments or ribbons along which these panels are stitched to form their respective two-layer hems with the legs of the loop 209 covering the stitched fabric layers of the joint 206. To facilitate the production of this construction the upper portion of the joint 206 has been flared or splayed. In this manner the needle or needles of the bar tack machine are facilitated in their movement and not continuously inhibited by an inordinate number of fabric layers.

Each of the loops 210, 211, 212, is attached to the bag 200 in a manner similar to the attachment of the loop 209 to the bag 200. The man skilled in the art following this Specification may rotate the loops counter-clockwise as illustrated in FIG. 1 and also in FIG. 4. As illustrated, the depending legs of the loops are arranged to rotate the upper portions of the joints 206, 207, 208, and 205, in a counter clock-wise direction.

The assembled bag, as illustrated in FIG. 1, was readily produced utilizing heavy vertical and horizontal cable stitching and bar tack machines for attaching the loops to the vertical joints with vertically spaced "squares" and "X's". The assembled bags had no raw edges on the exterior and were formed with the selvages on the inside. The six fabric layer vertical joints cooperated with the loops made of strong web material to form vertical members of great tensile strength and the individual panels of the bag were so arranged that the warp flat filaments or ribbons extended vertically in line with the corner joints of the bag. The bags resulting from this construction were economical, efficient, and so strong that they were certified as passing appropriate load, drop, and other pertinent tests.

It is to be understood that a preferred form has been illustrated and described and that the instant invention may be modified without departing from its spirit which may be limited only by the appended claims literally taken or in their equivalent forms.

What is claimed is:

1. In a flexible intermediate bulk container having four upper supporting loops of web material and a vertical walled body portion comprising:

four upright adjacent panels of woven fabric, each panel having a horizontal cut edge turned inwardly at the panel top and a horizontal cut edge turned inwardly at the panel bottom, each panel being vertically hemmed at two uncut vertically disposed selvages at the two panel sides with each selvage on the inside, each panel having a first side hem margin turned outwardly and then inwardly to form, in horizontal section, a "U" formation with two spaced apart legs, each panel having a second side hem turned outwardly and extending between the two legs of the "U" formation of an adjacent panel, a vertical row of continuous stitching assembling four fabric layers of the "U" formation of each panel with two fabric layers of the hem of an adjacent panel in an interlocking arrangement presenting a strong vertical member extending in horizontal section diagonally outwardly from said vertically walled body portion from the bottom thereof to a place short of the top thereof, the upper portion of the stitched six layer assembly being turned in splayed or flared fashion to overlay an adjacent panel, each of the four loops being in the form of an inverted "U" having two depending legs, one of said depending legs extending downwardly inside and in overlaying position of only the upper portion of said vertical body and the second of said depending legs extending downwardly outside said vertical body and only over the said splayed or flared portion of said six layer assembly, said two depending legs being fastened together above the top of the vertical walled body portion by a square and "X" stitch and below the top of the vertical walled body portion by a series of spaced apart square and "X" stitches in the area of the said splayed or flared portion.

2. The method of making a flexible intermediate bulk container having four upper supporting loops of web material comprising the steps of (a) cutting four panels from a bolt of woven fabric;

(b) arranging the panels so that the warp filaments are vertical;

(c) vertically hemming the panels adjacent their respective selvages;

(d) vertically joining the hemmed edges together with continuous vertical stitching and with one hemmed edge of one panel interlocked with the hemmed edge of an adjacent panel;

(e) cutting four lengths of web loop forming material from a roll;

(f) forming each length of web material into the shape of an inverted "U" having two depending legs;

(g) attaching one depending leg to the inside of said stitched panel structure nd attaching the second depending leg to the outside of said stitched panel structure with the closed end of loop above the top of the stitched panel structure;

(h) securing the two legs together above the top of the panel structure with a square and "X" stitch and below the top of the panel structure with a series of vertically spaced square and "X" stitch formations.

3. In a flexible intermediate bulk container having four upper supporting loops of web material and a vertical walled body portion comprising:

four side-hemmed upright adjacent panels of woven fabric joined together with vertical stitching at adjacent panel sides, each of the four loops being in the form of an inverted "U" having two depending legs, one of said depending legs extending downwardly inside and in overlaying position of only the upper portion of said vertical body, and the second of said depending legs extending downwardly outside and over only the upper portion of said vertical body, said two depending legs being fastened together above the top of the vertical walled body portion by a "box" or "square" and "X" stitch, and below the top of the vertical walled body portion by a series of vertically spaced apart "square" or "box" and "X" stitches.

4. A flexible intermediate bulk container in accordance with claim 1, wherein the upper portion of the six-layer assembly at each of the four corners of the vertical walled body portion is turned in a counterclockwise direction or from left to right when viewed in elevation.

5. The method of making a flexible intermediate bulk container in accordance with claim 2, including the step of rotating the upper portion of the continuous vertical interlocking hemmed edges of adjacent panels in a counterclockwise direction before attaching the depending legs of the web loop material to the stitched panel structure.

* * * * *